US008276776B2

(12) United States Patent
Roth et al.

(10) Patent No.: US 8,276,776 B2
(45) Date of Patent: Oct. 2, 2012

(54) LIDS AND CONTAINERS

(75) Inventors: Donna Roth, Plymouth, MA (US); Jason Meek, Bolton, CT (US)

(73) Assignee: Cool Gear International, LLC, Plymouth, MA (US)

( * ) Notice: Subject to any disclaimer, the term of this patent is extended or adjusted under 35 U.S.C. 154(b) by 23 days.

(21) Appl. No.: 12/953,767

(22) Filed: Nov. 24, 2010

(65) Prior Publication Data

US 2012/0125931 A1 May 24, 2012

(51) Int. Cl.
*B65D 51/18* (2006.01)

(52) U.S. Cl. ..... 220/254.4; 220/254.1; 220/836; 220/703; 220/298; 220/304; 220/713

(58) Field of Classification Search .... 220/254.1–254.9; 215/387; 229/404
See application file for complete search history.

(56) References Cited

U.S. PATENT DOCUMENTS

| | | | | |
|---|---|---|---|---|
| D48,464 | S | 1/1916 | Blair | |
| D75,773 | S | 7/1928 | Cleland | |
| 2,051,446 | A | 8/1936 | Ice | |
| D170,666 | S | 10/1953 | Stenger | |
| 2,984,035 | A | 5/1961 | Nalle, Jr. | |
| 3,456,860 | A | 7/1969 | Janninck | |
| 3,468,467 | A | 9/1969 | Amberg | |
| 3,606,262 | A | 9/1971 | Van't Hoff | |
| 3,606,282 | A | 9/1971 | Stookey | |
| 4,279,355 | A | 7/1981 | Schwartz et al. | |
| D291,040 | S | 7/1987 | Dart | |
| 4,852,757 | A | 8/1989 | Gold | |
| 4,915,250 | A | 4/1990 | Hayes, Jr. | |
| 5,148,936 | A * | 9/1992 | DeGrow | 220/254.3 |
| 5,203,467 | A * | 4/1993 | Tucker | 220/254.3 |
| 5,205,473 | A | 4/1993 | Coffin, Sr. | |
| 5,328,058 | A * | 7/1994 | Leoncavallo et al. | 222/153.14 |
| 5,456,380 | A | 10/1995 | Ito et al. | |

(Continued)

FOREIGN PATENT DOCUMENTS

CA 2255790 A1 7/1999

(Continued)

OTHER PUBLICATIONS

"At Your Disposal," Specialty Coffee Retailer 12-16 (Jun. 2001).

(Continued)

*Primary Examiner* — Luan K Bui
*Assistant Examiner* — Brijesh Patel
(74) *Attorney, Agent, or Firm* — Edwards Wildman Palmer LLP; Steven M. Jensen; Brian R. Landry

(57) ABSTRACT

One aspect of the invention provides a lid comprising: a base defining a first orifice; and a sealing member rotatably coupled to the base, the sealing member configured to seal the first orifice when placed in a sealing position. The base and the sealing member include one or more detents configured to releasably hold the sealing member in the sealing position. Still another aspect of the invention provides a container including a mug and a lid configured for releasable coupling with the mug. The lid includes a base defining a first orifice and a sealing member rotatably coupled to the base. The sealing member is configured to seal the first orifice when placed in a sealing position. The base and the sealing member include one or more detents configured to releasably hold the sealing member in the sealing position.

5 Claims, 5 Drawing Sheets

U.S. PATENT DOCUMENTS

| | | | | |
|---|---|---|---|---|
| 5,462,189 | A * | 10/1995 | Pierce | 220/815 |
| 5,509,568 | A | 4/1996 | Warden et al. | |
| D371,936 | S | 7/1996 | Goto et al. | |
| D372,398 | S | 8/1996 | Lamson | |
| 5,765,716 | A | 6/1998 | Cai et al. | |
| 5,826,786 | A | 10/1998 | Dickert | |
| D411,712 | S | 6/1999 | Mecklenburg | |
| 6,068,182 | A | 5/2000 | Tokunaga | |
| 6,220,476 | B1 | 4/2001 | Waller | |
| 6,286,709 | B1 | 9/2001 | Hudson | |
| 6,286,754 | B1 | 9/2001 | Stier et al. | |
| D475,578 | S | 6/2003 | Hurlbut et al. | |
| 6,659,302 | B2 * | 12/2003 | Lin | 220/254.8 |
| 6,732,876 | B2 * | 5/2004 | Belcastro | 220/253 |
| 6,763,964 | B1 | 7/2004 | Hurlbut et al. | |
| D502,396 | S | 3/2005 | Frisch et al. | |
| 6,886,707 | B2 * | 5/2005 | Giraud | 220/254.4 |
| 6,926,197 | B2 | 8/2005 | Hed et al. | |
| D509,707 | S | 9/2005 | Tien | |
| D512,874 | S | 12/2005 | Poulson et al. | |
| D526,190 | S | 8/2006 | Bolt et al. | |
| 7,131,550 | B2 * | 11/2006 | Vilalta et al. | 220/231 |
| 7,131,551 | B2 | 11/2006 | Smith | |
| D534,770 | S | 1/2007 | Gluck | |
| 7,175,043 | B2 | 2/2007 | O'Neal | |
| 7,246,715 | B2 | 7/2007 | Smith et al. | |
| 7,246,716 | B2 | 7/2007 | Durdon | |
| D548,012 | S | 8/2007 | Tien | |
| 7,284,676 | B2 | 10/2007 | Dantani | |
| D590,662 | S | 4/2009 | Cheng | |
| 7,513,380 | B2 * | 4/2009 | Canedo | 220/230 |
| 7,537,136 | B2 | 5/2009 | Hechmati | |
| D599,622 | S | 9/2009 | Gilbert et al. | |
| 7,581,640 | B2 | 9/2009 | Lopez | |
| 7,597,246 | B2 | 10/2009 | Stepanek, Jr. | |
| D623,474 | S | 9/2010 | Carlson et al. | |
| D623,476 | S | 9/2010 | Carlson et al. | |
| 2002/0096530 | A1 | 7/2002 | Waller | |
| 2003/0209547 | A1 | 11/2003 | Lin | |
| 2004/0084452 | A1 | 5/2004 | Hsieh | |
| 2005/0035018 | A1 | 2/2005 | McRobbie | |
| 2006/0086745 | A1 | 4/2006 | Morrison | |
| 2006/0186129 | A1 * | 8/2006 | Allnutt et al. | 220/737 |
| 2006/0213908 | A1 | 9/2006 | Clarke et al. | |
| 2007/0023442 | A1 | 2/2007 | Auzenne | |
| 2007/0045316 | A1 | 3/2007 | Arnljots | |
| 2007/0215618 | A1 | 9/2007 | Wright et al. | |
| 2007/0215626 | A1 | 9/2007 | Wright et al. | |
| 2008/0047966 | A1 | 2/2008 | Carson | |
| 2009/0065518 | A1 | 3/2009 | Carnevali | |

FOREIGN PATENT DOCUMENTS

| | | | |
|---|---|---|---|
| EP | 2103539 | A1 | 9/2009 |
| JP | 2005-525270 | A | 8/2005 |
| KR | 2008-0109896 | A | 12/2008 |

OTHER PUBLICATIONS

Caribou Coffee, "2005 Annual Report" (Mar. 30, 2006).

Caribou Coffee, "2007 Annual Report" (Mar. 21, 2008).

Karen Meyer, "Sleeves That Please: Find the perfect fit and feel for your shop," Specialty Coffee Retailer 42-51 (May 2007).

"Product Showcase 2008," Specialty Coffee Retailer 60-84 (Jul. 2008).

Bridget Weber, "Wearing your brand on your sleeve," Specialty Coffee Retailer 16-20 (Jul. 2004).

Wilton Industries, Inc., "Copco—Eco-First—Acadia Mug Brown" (Oct. 19, 2010).

Wilton Industries, Inc., "Copco—Eco-First—Sierra Tumbler Brown" (Oct. 19, 2010).

International Search Report for International Application No. PCT/US2011/060792 mailed Jun. 20, 2012.

Written Opinion for International Application No. PCT/US2011/060792 mailed Jun. 20, 2012.

* cited by examiner

LIDS AND CONTAINERS

BACKGROUND

Reusable mugs are becoming increasingly popular as consumers seek to reduce the environmental impact associated with disposable coffee cups. Such mugs handle extremely hot liquids and are often transported in automobiles or public transportation. Many existing reusable mugs are susceptible to leaks, particularly as the mug ages and/or when holding hot liquids that may generate elevated vapor pressures.

Accordingly, there is a need for improved lids and containers that are preferably leak-proof.

SUMMARY OF THE INVENTION

One aspect of the invention provides a lid comprising: a base defining a first orifice; and a sealing member rotatably coupled to the base, the sealing member configured to seal the first orifice when placed in a sealing position. The base and the sealing member include one or more detents configured to releasably hold the sealing member in the sealing position.

This aspect of the invention can have a variety of embodiments. The lid can include one or more detents include a tab positioned on the sealing member. The one or more detents can include a slot positioned on the sealing member. The one or more detents can include a tab positioned on the base. The one or more detents can include a slot positioned on the base.

The base and the sealing member can include one or more additional detents configured to releasably hold the sealing member in a drinking position. The one or more additional detents can include a tab positioned on the sealing member. The one or more additional detents can include a slot positioned on the sealing member. The one or more additional detents can include a tab positioned on the base. The one or more additional detents can include a slot positioned on the base.

The sealing member can rotate about a pivot point and at least one of the one or more additional detents can be located proximal to the pivot point. The sealing member can be held substantially flush with a surface of the base when in the drinking position. The sealing member can be held when in the drinking position at an angle relative to a surface of the base selected from the group consisting of: 25° or less, 20° or less, 15° or less, 10° or less, and 5° or less.

The first orifice can be formed on a spout. At least one of the one or more detents can be formed on the spout. The sealing member can include a first projection configured for insertion into the first orifice when the sealing member is placed in the sealing position. The first projection can include an elastomer.

The base can define a second orifice and the sealing member can include a second projection configured to press against the second orifice when the sealing member is placed in the sealing position. The second projection can include an elastomer. The elastomer can be silicone.

The base can include a threaded portion for coupling with a bottle. The threaded portion can include female threads.

The base can include one or tabs configured to releasably mate with a twist-lock groove.

The lid can include a gasket configured to form a seal between the base and a bottle. The gasket can be an elastomer. The elastomer can be silicone.

Another aspect of the invention provides a lid including a base and a sealing member rotatably coupled to the base. The base can include a spout, a first orifice formed on the spout, and a second orifice. The sealing member can include a first elastomeric projection configured for insertion into the first orifice when the sealing member is placed in a sealing position and a second elastomeric projection configured to press against the second orifice when the sealing member is placed in the sealing position. The base and the sealing member include one or more detents configured to releasably hold the sealing member in the sealing position. The one or more detents include a slot on the spout and a first tab on the sealing member. The base and the sealing member include one or more additional detents configured to releasably hold the sealing member in a drinking position. The one or more additional detents include a second tab on the sealing member and a third tab on the base.

Still another aspect of the invention provides a container including a mug and a lid configured for releasable coupling with the mug. The lid includes a base defining a first orifice and a sealing member rotatably coupled to the base. The sealing member is configured to seal the first orifice when placed in a sealing position. The base and the sealing member include one or more detents configured to releasably hold the sealing member in the sealing position.

This aspect of the invention can have a variety of embodiments. The mug can include a reversible sleeve. The mug and the base can include threaded portions. The mug and the base can include complimentary twist-lock geometries. The lid can further include a gasket configured to form a seal between the base and a bottle. The gasket can be an elastomer. The elastomer can be silicone.

FIGURES

For a fuller understanding of the nature and desired objects of the present invention, reference is made to the following detailed description taken in conjunction with the figure wherein.

DEFINITIONS

The instant invention is most clearly understood with reference to the following definitions:

As used in the specification and claims, the singular form "a," "an," and "the" include plural references unless the context clearly dictates otherwise.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from context, all numerical values provided herein are modified by the term about.

As used in the specification and claims, the terms "comprises," "comprising," "containing," "having," and the like can have the meaning ascribed to them in U.S. patent law and can mean "includes," "including," and the like.

Ranges provided herein are understood to be shorthand for all of the values within the range. For example, a range of 1 to 50 is understood to include any number, combination of numbers, or sub-range from the group consisting 1, 2, 3, 4, 5, 6, 7, 8, 9, 10, 11, 12, 13, 14, 15, 16, 17, 18, 19, 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, or 50 (as well as fractions thereof unless the context clearly dictates otherwise).

Unless specifically stated or obvious from context, as used herein, the term "or" is understood to be inclusive.

DESCRIPTION OF THE INVENTION

Various aspects of the invention provide lids and containers.

Figures 1A, 1B:
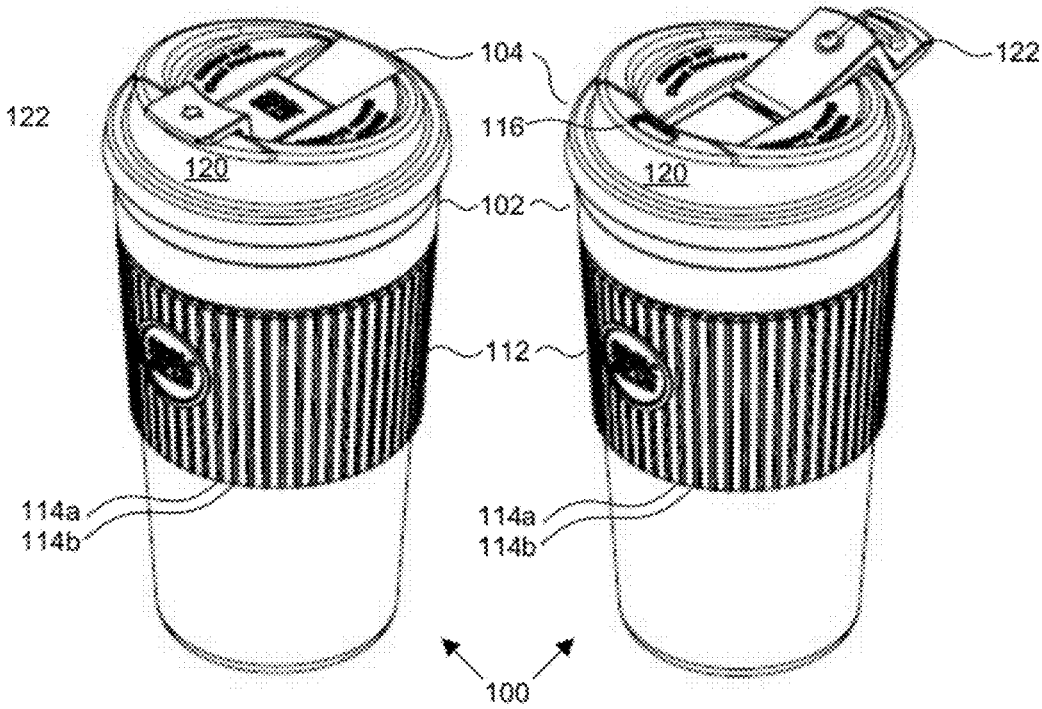
FIG. 1A is a perspective view of a container including a lid with a sealing member in a sealing position according to one embodiment of the invention.
FIG. 1B is a perspective view of a container including a lid with a sealing member in a sealing position according to one embodiment of the invention.

Referring now to FIGS. 1A and 1B, a container 100 is provided having a mug 102 and a lid 104.

Figure 1C:
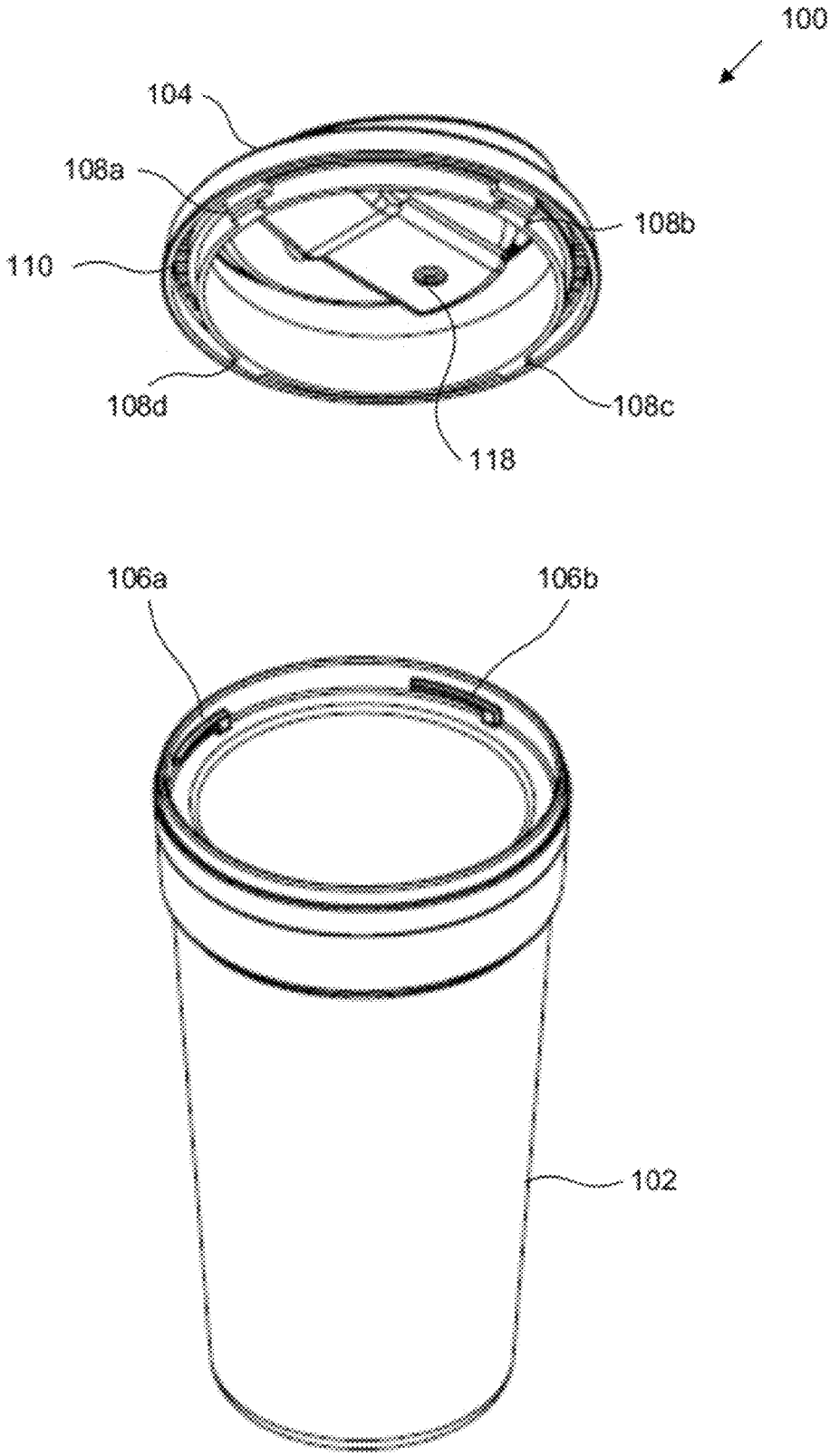
FIG. 1C is a partially-exploded view of a container according to one embodiment of the invention.

As depicted in FIG. 1C, lid 104 can be removably coupled to mug 102 through a variety of means such as male or female threads or twist-lock devices 106, 108. Mug 102 can include a plurality (e.g., 2, 3, 4, and the like) of twist-lock grooves 106 configured to receive complimentary twist-lock tabs 108 on lid 104. Such twist-lock devices 106, 108 allow for coupling of lid 104 to mug 102 by rotating the lid 104 less than 360° (e.g., 90° or less in an embodiment having 4 twist-lock devices 106, 108 as depicted in FIG. 10). Lid 104 can include a gasket 110 (e.g., an elastomeric gasket fabricated from a material such as silicone) to ensure that the seal between lid 104 and mug 102 is fluid-tight.

Referring again to FIGS. 1A and 1B, mug 102 can include a circumferential sleeve 112. The sleeve 112 can, in some embodiments, be made from an elastomer and can resemble a cardboard sleeve commonly placed on disposable coffee cups. For example, the sleeve 112 can have a brown pigment and/or one or more ribs 114 to simulate corrugated cardboard. In some embodiments, the mug 102 and lid 104 can be white to provide contrast between the sleeve 112 and the rest of container 100, thereby creating an aesthetically-pleasing container 100.

Sleeve 112 can be bonded to mug 102 (e.g., with an adhesive or by friction) or can be removable. A removable sleeve can be advantageous for cleaning and allows for interchangeability of sleeves of various colors.

Sleeve 112 can, in some embodiments, have designs on both the interior and exterior surface, thereby enabling the user to change the appearance of the container 100 without the need to obtain a new sleeve 112. For example, an exterior surface of sleeve 112 can have a cardboard appearance as discussed above and the interior surface can have a winter-holiday-themed design. The user can easily invert sleeve 112 (particularly when the sleeve is constructed from an elastomer) to reveal the desired design.

As visible in FIGS. 1B and 1C, lid 104 can have a first orifice 116 and a second orifice 118. In some embodiments, the first orifice 116 is configured for sipping a beverage and is larger than the second orifice 118, which can be a vent to break a vacuum during sipping. First orifice 116 can be formed on a spout 120, which can resemble spouts on disposable coffee cup lids for both aesthetics and functionality.

Lid also includes a sealing member 122 configured to seal the first orifice 116 (and the second orifice 118 when present) when placed in a sealing portion (depicted in FIG. 1A.) Sealing member 122 is rotatably coupled to the base portion of the lid 104 (e.g., by cylindrical tabs received within slots in the base).

Sealing member 122 can include a first projection 124 configured to seal (e.g., by pressing against or insertion within) the first orifice 116 when the sealing member 122 is placed in the sealing position. Sealing member can also include a second projection 126 configured to seal (e.g., by pressing against or insertion within) the second orifice 118 when the sealing member 122 is placed in the sealing position. The first projection 124 and second projection 126 can included an elastomeric material such as silicone. In some embodiments, the first projection 124 and the second projection 126 are fabricated as unitary piece of material as depicted in FIG. 1B.

Figures 1D, 1E, 1F, 1G:
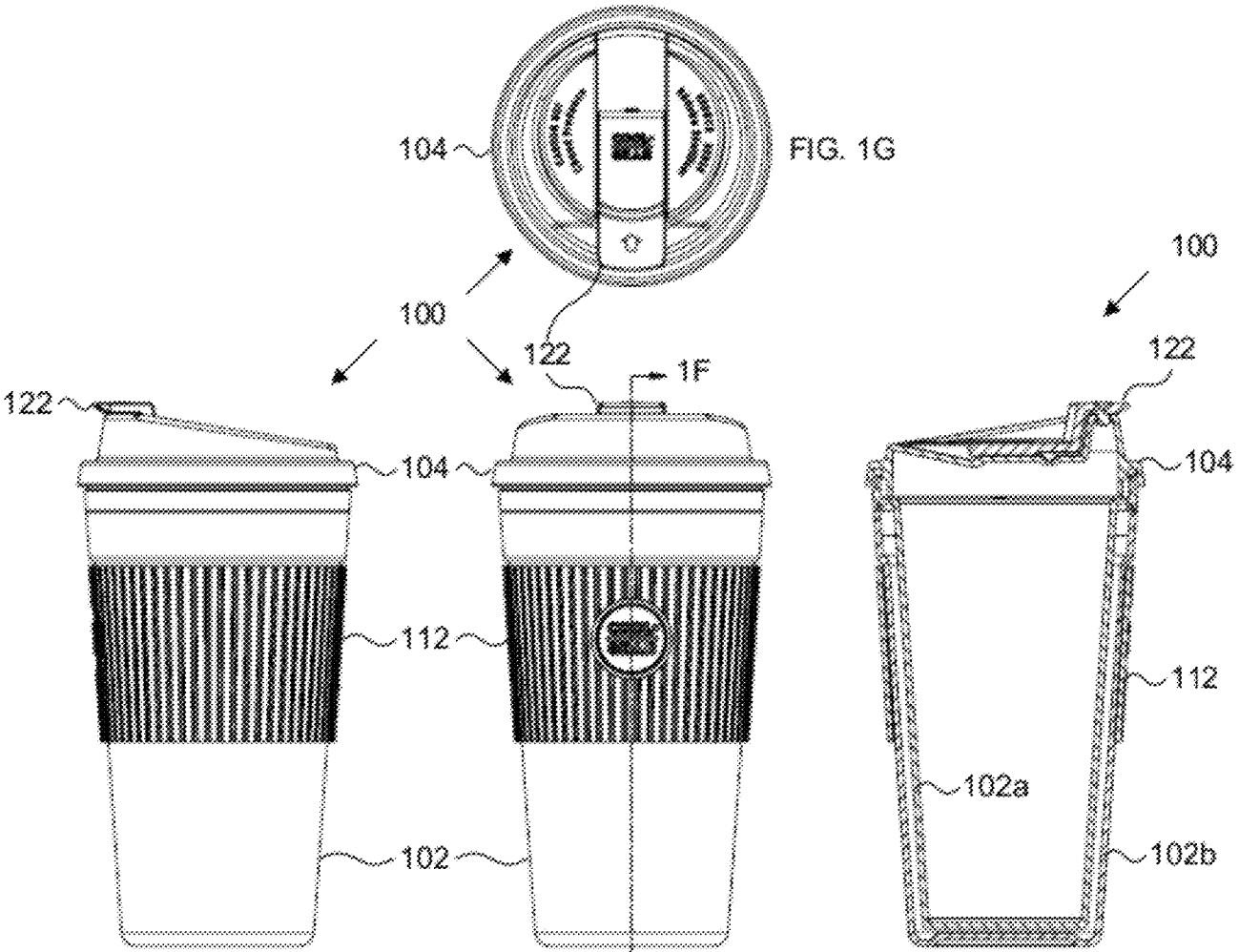
FIG. 1D is a side view of a container according to one embodiment of the invention.
FIG. 1E is a front view of a container according to one embodiment of the invention.
FIG. 1F is a cross-sectional view of a container according to one embodiment of the invention.
FIG. 1G is a top view of a container according to one embodiment of the invention.

Referring now to FIG. 1F, a cross-section of a container 100 is depicted. As seen clearly in cross-section, mug 102 can be double-walled such that an inner wall 102*a* and an outer wall 102*b* define an insulating gap.

Figure 1H:
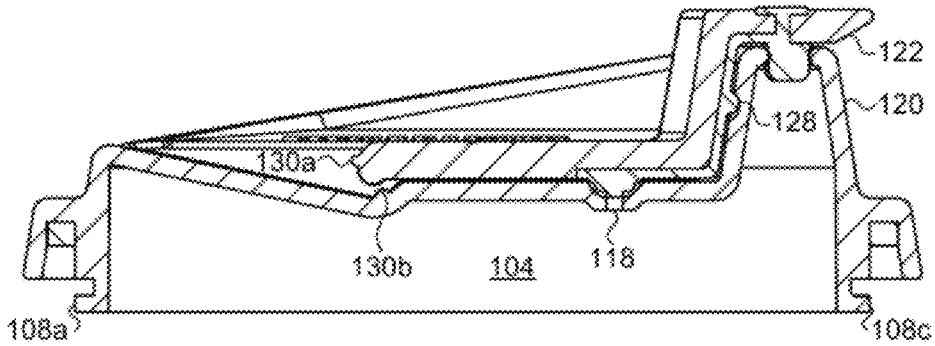
FIG. 1H is a cross-sectional view of a lid in a sealing position according to one embodiment of the invention.
Figure 1I:
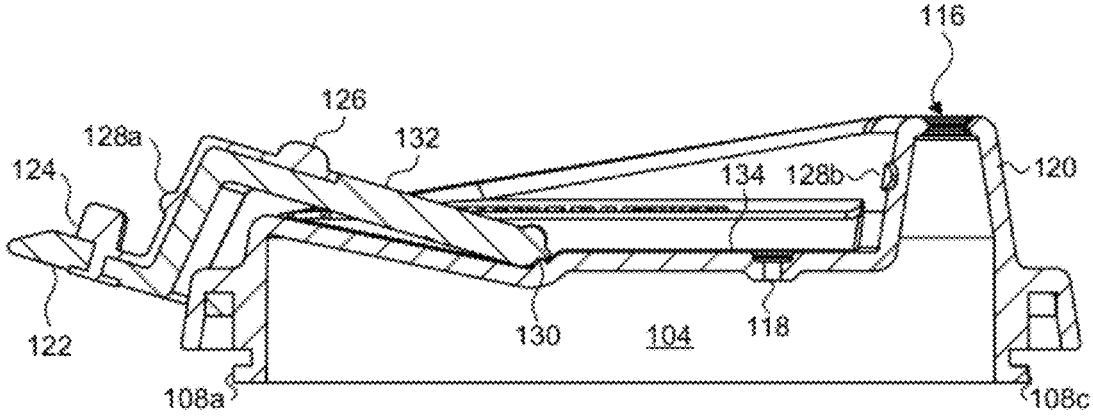
FIG. 1I is a cross-sectional view of a lid in a drinking position according to one embodiment of the invention.

Referring now to FIGS. 1H and 1I, lid 104 can include a first set of detents 128 configured to releasably hold the sealing member 122 in the sealing position. Although the embodiment depicted in FIGS. 1H and 1I includes a tab 128*a* positioned on sealing member 122 that is received in a corresponding slot 128*b* formed on spout 120, other embodiments can be employed. For example, a tab on spout 120 can interact with a slot formed on sealing member 122. Likewise, tabs can be formed on both the spout 120 and the sealing member 122 such that one or more of the tabs (and/or the component that the one or more the tabs are formed on) temporarily deflects during movement of the sealing member 122 to the sealing position. Once in the sealing position, the component return to their normal geometries and the tabs hold the sealing member 122 in the sealing position.

To further enhance the sealing function of lid 104, the first projection 124 and/or second projection 126 can be oversized with respect to the first orifice 116 and/or the second orifice 118 such that the first projection 124 and/or second projection 126 are compressed when the sealing member 122 is held in the sealing position. In some embodiments, the first projection 124 and/or second projection 126 can have a flared or hourglass shape such that a wider portion expands after insertion within the first orifice 116 and/or the second orifice 118.

Still referring to FIGS. 1H and 1I, lid 104 can also include a second set of detents 130 configured to releasably hold the sealing member in a drinking position. Although the embodiment depicted in FIGS. 1H and 1I includes a tab 130*a* positioned on sealing member 122 that interacts with a corresponding tab 130*b* formed on lid 104, other embodiments can be employed. For example, a tab on sealing member 122 can interact with a slot formed on lid or vice versa. As depicted in FIGS. 1H and 1I, the second set of detents 130 can be proximal to a pivot point of sealing member 122.

Sealing member 122 can be held substantially flush with a surface of the base when in the drinking position. For example, referring to FIG. 1I, the bottom surface 132 of the sealing member 122 can be held in the drinking position at an angle of about 25° or less, about 20° or less, about 15° or less, about 10° or less, or about 5° or less with respect to surface 134 of lid 104.

Figure 1J:
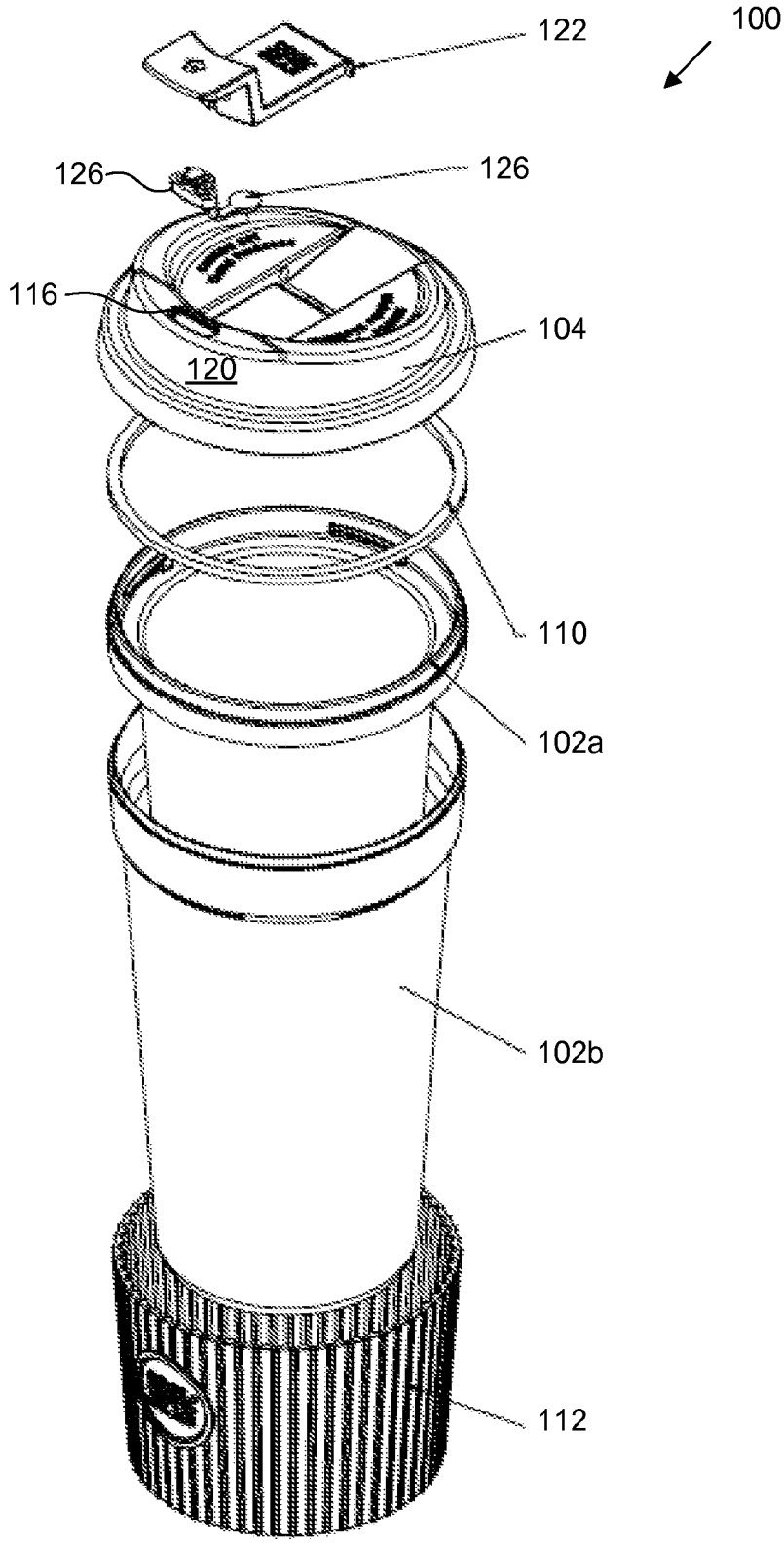
FIG. 1J is an exploded view of a container according to one embodiment of the invention.

Referring now to FIG. 1J, an exploded view of container 100 is provided to allow for further visualization of an embodiment of the invention described herein.

EQUIVALENTS

Although preferred embodiments of the invention have been described using specific terms, such description is for illustrative purposes only, and it is to be understood that changes and variations may be made without departing from the spirit or scope of the following claims.

Optional Use of Color

Although the drawings provided herein are black and white line drawings, the invention provided herein can optionally include various colors to enhance its aesthetic appearance. For example, in one embodiment, all components of the invention are made from opaque white plastic except for elastomeric sleeve 112 (which can be a brown thermoplastic rubber such as PANTONE 7504), gasket 110 (which can be a brown silicone such as PANTONE 7504), and projections 124 and/or 126 (which can be a green silicone such as PANTONE 382).

As appreciated by those of skill in the art, PANTONE 7504 and PANTONE 382 correspond to (152, 115, 74) and (181, 220, 16), respectively, on the RGB (red, green, blue) color model.

INCORPORATION BY REFERENCE

The entire contents of all patents, published patent applications, and other references cited herein are hereby expressly incorporated herein in their entireties by reference.

The invention claimed is:

1. A lid comprising:

a base including:

a spout;

a first orifice formed on the spout; and a second orifice; and a sealing member rotatably coupled to the base, the sealing member including:

a first elastomeric projection configured for insertion into the first orifice when the sealing member is placed in a sealing position; and a second elastomeric projection configured to press against the second orifice when the sealing member is placed in the sealing position;

wherein the base and the sealing member include one or more detents configured to releasably hold the sealing member in the sealing position, the one or more detents comprising a slot on the spout and a first tab on the sealing member; and wherein the base and the sealing member include one or more additional detents configured to releasably hold the sealing member in a drinking position, the one or more additional detents comprising a second tab on the sealing member and a third tab on the base that engages with the second tab when the sealing member is in the drinking position and wherein the sealing member is held substantially flush with a surface of the base and the first elastomeric projection is facing upwardly when in the drinking position.

2. The lid of claim 1, wherein the sealing member rotates about a pivot point and at least one of the one or more additional detents are located proximal to the pivot point.

3. The lid of claim 1, wherein the sealing member is held, when in the drinking position, at an angle relative to a surface of the base selected from the group consisting of: 25° or less, 20° or less, 15° or less, 10° or less, and 5° or less.

4. A container comprising:

a mug; and a lid according to claim 1.

5. The container of claim 4, wherein the mug includes a reversible sleeve.

* * * * *